US010094391B2

(12) United States Patent
Miyoshi et al.

(10) Patent No.: US 10,094,391 B2
(45) Date of Patent: Oct. 9, 2018

(54) COMPRESSOR HOUSING FOR SUPERCHARGER

(71) Applicant: TOYOTA JIDOSHA KABUSHIKI KAISHA, Toyota-shi (JP)

(72) Inventors: Tomoki Miyoshi, Nishio (JP); Tomoyuki Isogai, Toyota (JP); Koichi Yonezawa, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 231 days.

(21) Appl. No.: 15/051,101

(22) Filed: Feb. 23, 2016

(65) Prior Publication Data

US 2016/0245304 A1 Aug. 25, 2016

(30) Foreign Application Priority Data

Feb. 25, 2015 (JP) ..... 2015-034669

(51) Int. Cl.
*F04D 29/44* (2006.01)
*F04D 29/62* (2006.01)
(Continued)

(52) U.S. Cl.
CPC ..... *F04D 29/441* (2013.01); *F02B 33/40* (2013.01); *F04D 29/023* (2013.01);
(Continued)

(58) Field of Classification Search
CPC ..... F04D 29/023; F04D 29/162; F04D 29/40; F04D 29/42; F04D 29/4206;
(Continued)

(56) References Cited

U.S. PATENT DOCUMENTS 4,780,055 A * 10/1988 Zloch ..... F04D 29/462 415/160
5,333,990 A 8/1994 Foerster et al.
(Continued)

FOREIGN PATENT DOCUMENTS

DE 199 20 524 C2 12/2001
DE 10 2012 217 381 A1 3/2014
(Continued)

*Primary Examiner* — David E Sosnowski
*Assistant Examiner* — Sang K Kim
(74) *Attorney, Agent, or Firm* — Oblon, McClelland, Maier & Neustadt, L.L.P.

(57) ABSTRACT

A compressor housing includes an intake port, a scroll, and a shroud. The shroud includes a shroud surface facing the impeller, a sliding member in an annular shape, and a sliding-member fixing portion in an annular shape. An inner circumferential surface of the sliding member defines the shroud surface. The sliding-member fixing portion includes contact portions that are configured to such that an inner circumferential surface of the sliding-member fixing portion and an outer circumferential surface of the sliding member at least partially come into contact with each other. The sliding member is fastened to the sliding-member fixing portion at the contact portions by the fastening members. The sliding member is fastened by the fastening members configured to extend through the sliding-member fixing portion. The fastening members are fastened from an outer circumferential surface of the sliding-member fixing portion to the sliding member.

8 Claims, 7 Drawing Sheets

(51) Int. Cl.
*F02B 33/40* (2006.01)
*F04D 29/02* (2006.01)
*F04D 29/16* (2006.01)

(52) U.S. Cl.
CPC ..... *F04D 29/162* (2013.01); *F04D 29/624* (2013.01); *F05D 2220/40* (2013.01); *F05D 2300/432* (2013.01); *F05D 2300/434* (2013.01); *F05D 2300/44* (2013.01)

(58) Field of Classification Search
CPC .. F04D 29/4213; F04D 29/441; F04D 29/624; F05B 33/40; F05D 2220/40; F05D 2300/432; F05D 2300/434; F05D 2300/44; F01D 9/026; F01D 25/24; F01D 25/243; F01D 25/28
See application file for complete search history.

(56) References Cited

U.S. PATENT DOCUMENTS 5,785,493 A 7/1998 Ojima et al.
6,394,751 B1 * 5/2002 Daudel ..... F04D 27/0207 415/208.3
6,916,153 B2 * 7/2005 Boening ..... F01D 17/165 415/163
8,061,976 B2 * 11/2011 Hall ..... B23P 19/084 415/160
8,393,851 B2 * 3/2013 Schlienger ..... F04D 27/0292 415/126
9,188,129 B2 * 11/2015 Walter ..... F01D 25/24
9,435,346 B2 * 9/2016 Osuka ..... B22C 9/24
2004/0109760 A1 * 6/2004 Jones ..... F01D 1/02 415/206
2012/0321440 A1 * 12/2012 Zheng ..... F04D 29/685 415/58.4
2014/0147256 A1 5/2014 Isogai
2014/0169958 A1 6/2014 Fiedler et al.
2015/0159664 A1 * 6/2015 Olin ..... F02C 7/045 415/58.2

FOREIGN PATENT DOCUMENTS

EP 2 713 057 A2 4/2014
JP 9-170442 6/1997
JP 2013-170545 A 9/2013
JP 2014-70628 A 4/2014
WO WO 2013/014743 A1 1/2013

* cited by examiner

COMPRESSOR HOUSING FOR SUPERCHARGER

INCORPORATION BY REFERENCE

The disclosure of Japanese Patent Application No. 2015-034669 filed on Feb. 25, 2015 including the specification, drawings and abstract is incorporated herein by reference in its entirety.

BACKGROUND

1. Technical Field

The present disclosure relates to a compressor housing for a supercharger.

2. Description of Related Art

Compressors (compression machines) used in superchargers, such as turbochargers, of automobiles have compressor housings. Compressor housings are configured to house impellers therein. Each compressor housing has an intake port, a scroll chamber, and a shroud surface. The intake port is configured to take in air toward the impeller. The scroll chamber is formed outward of a circumference of the impeller in a circumferential direction. The scroll chamber introduces the air discharged from the impeller. The shroud surface is so disposed as to face the impeller.

In the above configured compressor, a gap between impeller blades and the shroud surface of the compressor housing is set to be as small as possible, thereby enhancing compression efficiency of the compressor. However, if the gap is too small, damages might be caused to the impeller. Such damages might be caused, for example, if the impeller blades come into contact with the shroud surface of the compressor housing due to vibrations, run-out of a rotational axis of the impeller, or the like.

Japanese Patent Application Publication No. 9-170442 discloses a structure of providing a sliding member made of a softer resin or the like than an impeller blade to a portion where a shroud surface of a compressor housing is formed. According to this, even if the impeller blades come into contact with the shroud surface of the compressor housing due to vibrations, run-out of the impeller rotation axis, or the like, only the sliding member provided to the portion where the shroud surface is formed becomes cut. Hence, no damage is caused to the impeller. A gap between the impeller blades and the shroud surface of the compressor housing is maintained to be small.

SUMMARY

In the above JP 9-170442, in order to fix the sliding member to the shroud, the sliding member is enlarged to a diffuser that does not face the impeller. The sliding member is fasteningly fixed to the shroud via screw holes provided to the diffuser. Accepting recess portions for accepting heads of screw members are provided to a diffuser surface of the sliding member so as to prevent the heads of the screw members from projecting from the diffuser surface toward a fluid passage. Unfortunately, each accepting recess portion opens toward the fluid passage, thus affecting the intake air flowing through the fluid passage. Consequently, this affection might cause disturbance of the air flow and deterioration of compression efficiency. In addition, there is a concern that water or the like being collected in the accepting recess portions might become one of causes of corrosion. To cope with such problems, it can be considered to fill the accepting recess portions with putty after the heads of the screw members are inserted in the screw holes. However, this method has demerits, such as increase in manufacturing process and increase in material cost. In order to secure an area for fixing the screw members to the sliding member, the sliding member is enlarged to the diffuser that is an area not facing the impeller. This might cause increase in dimension of the sliding member. A material of forming the sliding member is generally more costly than a material of forming the compressor housing. Hence, increase in dimension of the sliding member is disadvantageous to cost efficiency.

Provided is a compressor housing for a supercharger capable of preventing deterioration of compression efficiency, and advantageous to cost efficiency.

In one aspect of an embodiment, provided is a compressor housing for a supercharger. The compressor housing includes an intake port, a scroll, and a shroud. The intake port is configured to house an impeller therein. The intake port is configured to take in air toward the impeller. The scroll has a scroll chamber, and the scroll chamber is configured to introduce the air discharged from the impeller. The shroud includes a shroud surface, and the shroud surface faces the impeller. The shroud includes a sliding member in an annular shape and a sliding-member fixing portion in an annular shape. An inner circumferential surface of the sliding member defines the shroud surface. The sliding-member fixing portion includes contact portions. The contact portions are configured to such that an inner circumferential surface of the sliding-member fixing portion and an outer circumferential surface of the sliding member at least partially come into contact with each other. The sliding member is fastened to the sliding-member fixing portion at the contact portions by the fastening members. The sliding member is fastened by the fastening members configured to extend through the sliding-member fixing portion. The fastening members are fastened from an outer circumferential surface of the sliding-member fixing portion to the sliding member.

In the aforementioned compressor housing for a supercharger, the sliding member is fastened to the sliding-member fixing portion by the fastening members. The fastening members are disposed in a manner as to extend through the sliding-member fixing portion from the outer circumferential surface of the sliding-member fixing portion toward the sliding member. Accordingly, the fastening members can be prevented from being exposed to the fluid passage. Hence, it is unnecessary to provide any accepting recess portion to prevent part of the fastening members from projecting from a diffuser surface toward the fluid passage. Accordingly, on the shroud surface of the sliding member, it is possible to prevent disturbance of the air flow discharged from the impeller, thus preventing deterioration of compression efficiency.

It is also unnecessary to provide any accepting recess portion to the diffuser surface. Hence, no water or the like is collected, and thus there is no concern about corrosion. In addition, it is possible to eliminate a process to fill the accepting recess portions with putty or the like, which prevents increase in material cost. It is unnecessary to enlarge the sliding member to the diffuser that is an area not facing the impeller in order to secure an area for fixing the fastening members to the sliding member. Accordingly, it is possible to promote reduction in dimension of the sliding member, which is advantageous to cost efficiency.

As aforementioned, according to the present invention, it is possible to provide the compressor housing for a supercharger capable of preventing deterioration of compression efficiency, and advantageous to cost efficiency.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

A compressor housing for a supercharger of the embodiments may be used in a supercharger, such as a turbocharger, of an automobile.

Figure 1:
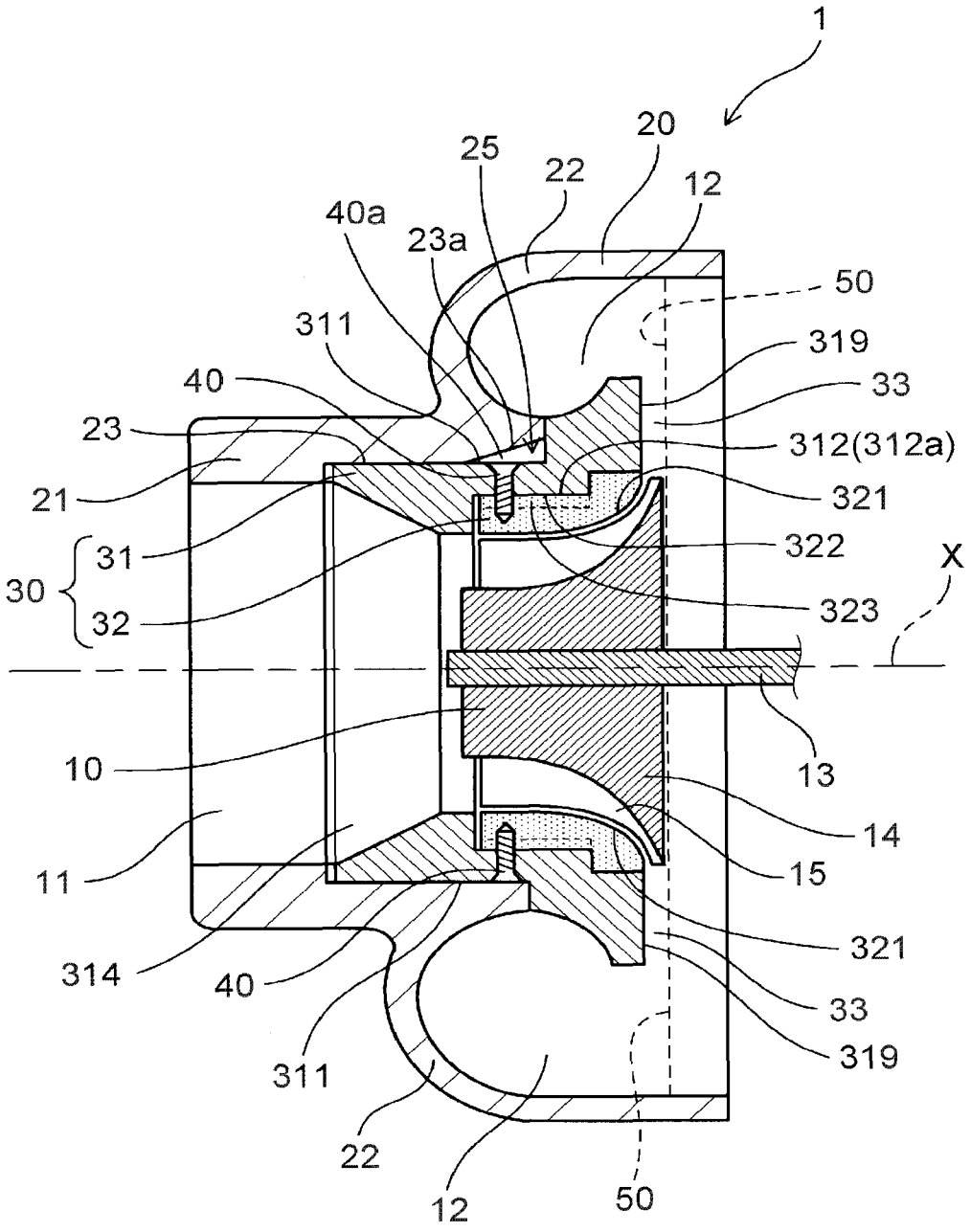
FIG. 1 is a sectional view of a turbocharger including a compressor housing for a supercharger in a first embodiment.

The compressor housing for a supercharger of the present embodiment will be described with reference to FIG. 1 to FIG. 5. The compressor housing 1 for a supercharger of the present embodiment is configured to house an impeller 10 therein, as shown in FIG. 1. The compressor housing 1 includes a scroll 20 and a shroud 30. The scroll 20 has an intake port 11, and a scroll chamber 12. The intake port 11 is configured to take in air toward the impeller 10. The scroll chamber 12 is formed outward of a circumference of the impeller 10 in the circumferential direction. The scroll chamber 12 is configured to introduce the air discharged from the impeller 10. The shroud 30 includes an annular sliding member 32 and an annular sliding-member fixing portion 31. The sliding member 32 includes a shroud surface 321 facing the impeller 10 and being defined by an inner circumferential surface 312 of the sliding member 32. An inner circumferential surface 312 of the sliding-member fixing portion 31 has contact portions 312*a* that come into contact with at least part of an outer circumferential surface 322 of the sliding member 32. At the contact portions 312*a*, the sliding member 32 is fastened to the sliding-member fixing portion 31 by fastening members 40. Each fastening member 40 is so fixed as to extend through the sliding-member fixing portion 31 from an outer circumferential surface 311 of the sliding-member fixing portion 31 toward the sliding member 32.

Figure 2:
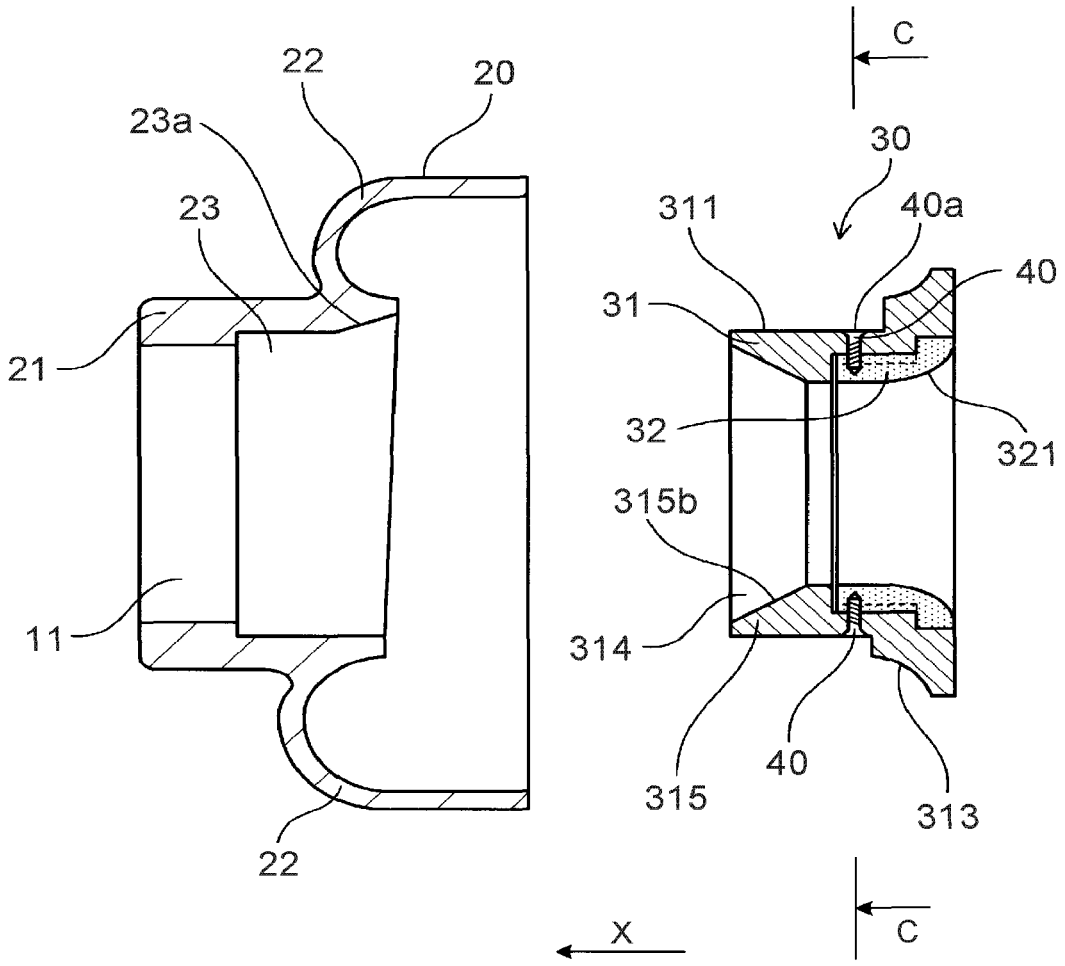
FIG. 2 is an exploded sectional view of the compressor housing for a supercharger in the first embodiment.

As shown in FIG. 1 and FIG. 2, the compressor housing 1 defines an outer shell of a compressor used in a turbocharger of an automobile. The compressor housing 1 is configured in combination of the scroll 20 and the shroud 30.

Hereinafter, components of the compressor housing 1 of the present embodiment will be described in details. As shown in FIG. 1 and FIG. 2, the scroll 20 includes the intake port 11, a scroll-chamber defining portion 22, and a shroud press-fitting portion 23. The intake port 11 is defined by an intake-port defining portion 21 in a cylindrical shape. The shroud press-fitting portion 23 has a cylindrical shape corresponding to the outer circumferential surface 311 of the sliding-member fixing portion 31. The shroud press-fitting portion 23 is configured such that the shroud 30 is press-fitted into the shroud press-fitting portion 23 in the axial direction X of a rotational shaft 13 of the impeller 10. The scroll-chamber defining portion 22 in cooperation with a scroll-chamber defining portion 313 of the sliding-member fixing portion 31 is configured to define the scroll chamber 12. In the present embodiment, the scroll 20 is configured by a die cast product made of aluminum. Materials of forming the scroll 20 and the sliding-member fixing portion 31 are not limited to specific ones, and aluminum, iron, plastics, and others may be employed.

Figure 3:
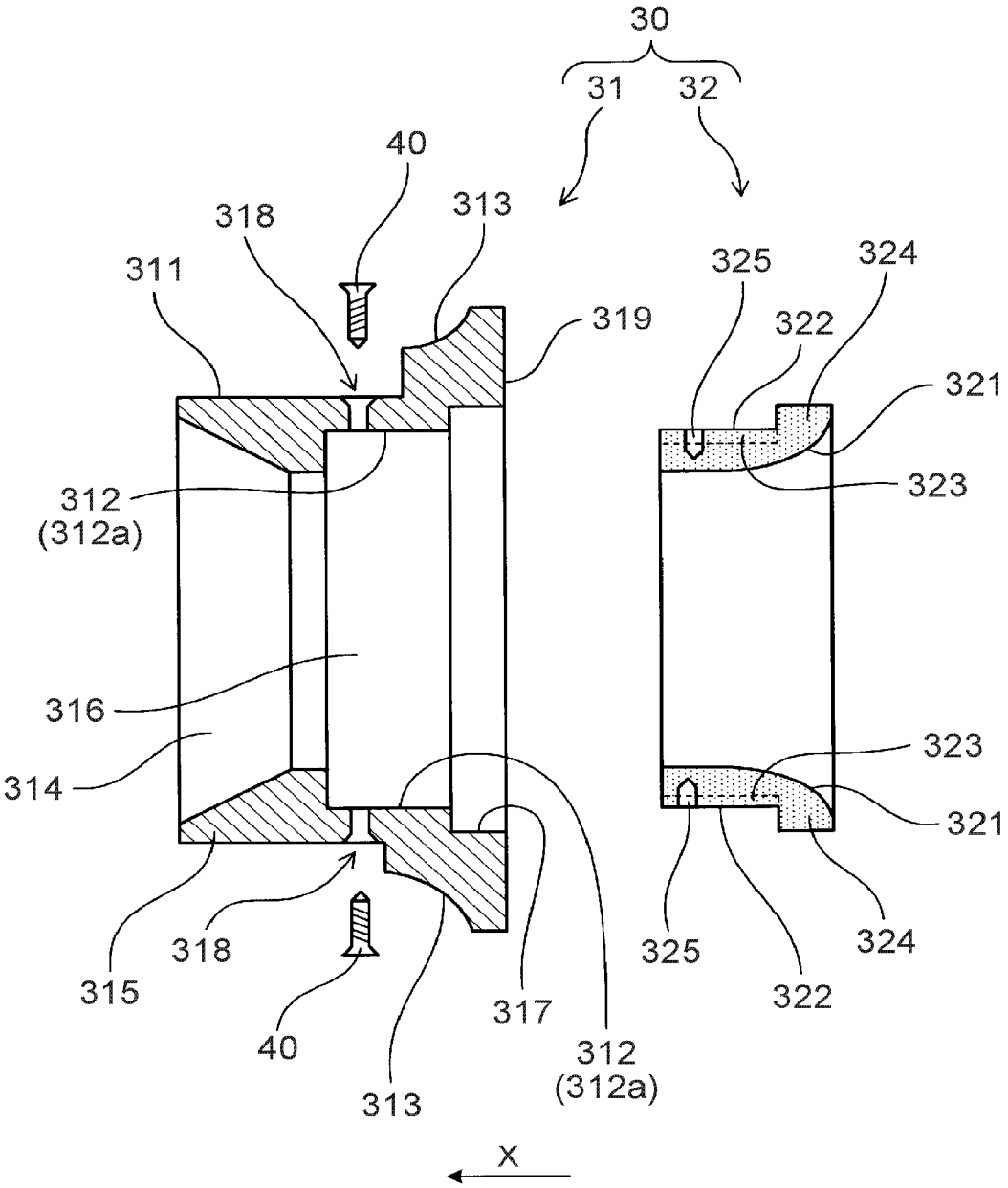
FIG. 3 is an exploded sectional view of a shroud in the first embodiment.

As shown in FIG. 3, the shroud 30 includes the sliding-member fixing portion 31 and the sliding member 32. As shown in FIG. 2 and FIG. 3, the sliding-member fixing portion 31 includes the scroll-chamber defining portion 313, a cylindrical press-fitted portion 315, and a sliding-member disposing portion 316. The scroll-chamber defining portion 313 defines part of the scroll chamber 12. The cylindrical press-fitted portion 315 is press-fitted into the shroud press-fitting portion 23. The cylindrical press-fitted portion 315 defines an intake passage 314 communicating with the intake port 11. The sliding member 32 is disposed to the sliding-member disposing portion 316. The sliding-member fixing portion 31 has an annular shape. Contact portions 312*a* are formed on the inner circumferential surface 312 of the sliding-member disposing portion 316. At the respective contact portions 312*a*, the inner circumferential surface 312 comes into contact with linear projections 323 of the sliding member 32 described later. As shown in FIG. 1, a bearing housing or an end surface 50 of a back plate of the impeller 10 is located on an opposite side to the intake port 11 of the sliding-member fixing portion 31. A diffuser 33 is formed between the end surface 50 and the sliding-member fixing portion 31. The diffuser 33 serves as a fluid passage from the impeller 10 to the scroll chamber 12. A surface of the sliding-member fixing portion 31 that faces the end surface 50 is defined as a diffuser surface 319.

Figure 4:
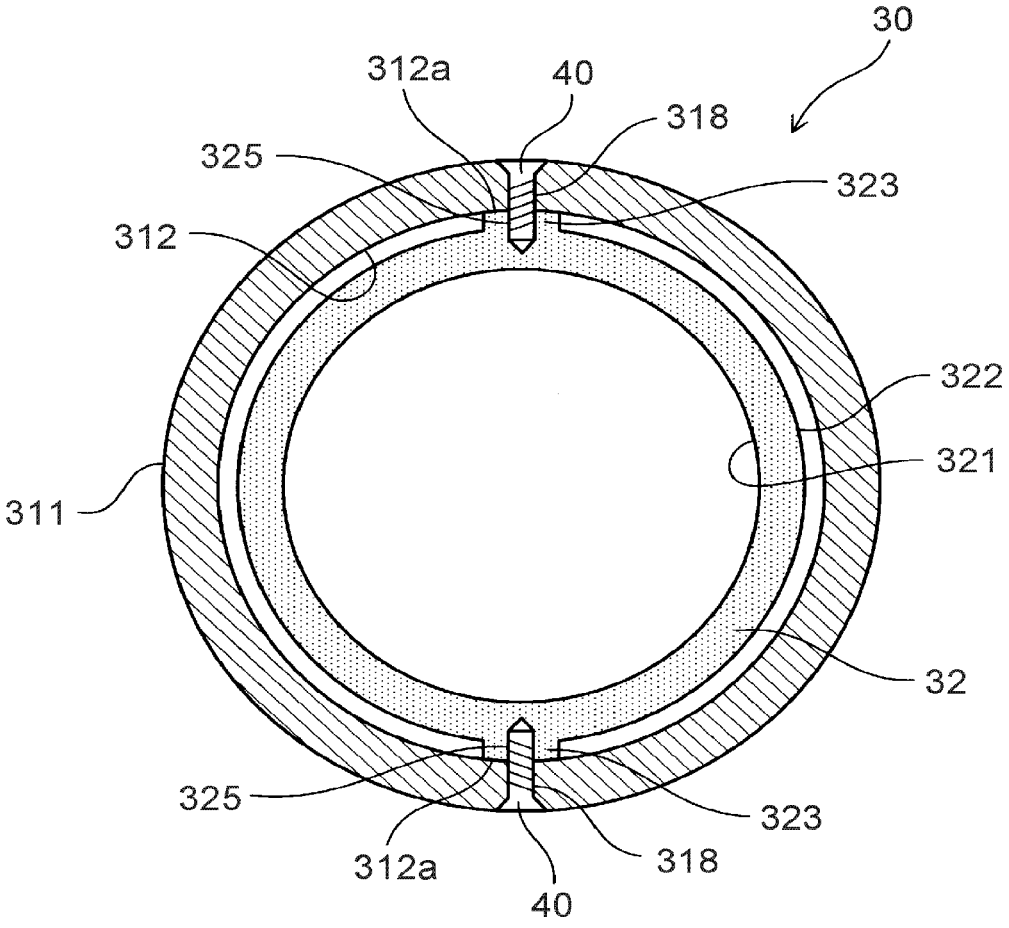
FIG. 4 is a sectional view taken along line II-II in FIG. 2.

In the present embodiment, the sliding member 32 is formed of a polyimide resin. The material of forming the sliding member 32 is not limited to this, and Teflon (registered trademark), a PPS (polyphenylene sulphide) resin, a PEEK (polyether ether ketone) resin, and others may be employed. As shown in FIG. 3, the sliding member 32 has an annular shape. The sliding member 32 is inserted into the sliding-member disposing portion 316 of the sliding-member fixing portion 31 in the axial direction X. The sliding member 32 is provided with linear projections 323 at a position facing the corresponding contact portions 312*a* of the sliding-member disposing portion 316. As shown in FIG. 4, each linear projection 323 is so formed as to project from the outer circumferential surface 322 of the sliding member 32 toward each corresponding contact portion 312*a*. As shown in FIG. 3, each linear projection 323 extends in the axial direction X on the outer circumferential surface 322 of the sliding member 32. As shown in FIG. 4, the linear projection 323 is provided at two positions in the diameter direction on the outer circumferential surface 322 of the sliding member 32.

The sliding member 32 includes an enlarged-diameter portion 324 at a rear end thereof in a direction in which the sliding member 32 is inserted. The diameter of the enlarged-diameter portion 324 is enlarged toward the rear end which is the downstream side of the air flow. A direction in which the sliding member 32 is inserted is defined as the axial direction X. The rear end of the sliding member 32 is defined to be located on an opposite side to the intake port 11 relative to the fastening members 40. The sliding-member fixing portion 31 includes a press-fitting recess portion 317 into which the enlarged-diameter portion 324 is press-fitted, at a position of the sliding-member fixing portion 31 facing an outer circumferential surface of the enlarged-diameter portion 324.

As shown in FIG. 1, an inner circumferential surface of the sliding member 32 faces the impeller 10, and defines the shroud surface 321 corresponding to the impeller 10. In the present embodiment, the entire inner circumferential surface of the sliding member 32 faces the impeller 10, and the entire inner circumferential surface of the sliding member 32 defines the shroud surface 321.

As shown in FIG. 3 and FIG. 4, the sliding member 32 disposed in the sliding-member disposing portion 316 is fastened to the sliding-member fixing portion 31 through the fastening members 40. Each fastening member 40 is fixed through each corresponding screw hole 318 and each corresponding screw hole 325. Each screw hole 318 extends through the sliding-member fixing portion 31 from the outer circumferential surface 311 of the sliding-member disposing portion 316 of the sliding-member fixing portion 31. Each screw hole 325 is provided to each corresponding linear projection 323 of the sliding member 32. In the present embodiment, each fastening member 40 is a screw member of which head has a dish shape. In the present embodiment, the sliding member 32 is inserted in the inner circumferential surface 312 of the sliding-member fixing portion 31 in the axial direction X of the impeller 10. Each fastening member 40 extends through the sliding-member fixing portion 31 in a direction orthogonal to the axial direction X. Each fastening member 40 is accepted in each corresponding screw hole 318. Each fastening member 40 is configured such that the head of the fastening member 40 does not project from the outer circumferential surface 311 of the sliding-member disposing portion 316. Each fastening member 40 is disposed at a position closer to the front end in the direction in which the sliding member 32 is inserted (closer to the intake port 11 in the X direction) than the enlarged-diameter portion 324. Herein, the front end is defined to be located on the same side as that of the intake port 11 relative to the fastening members 40.

As shown in FIG. 1, the impeller 10 is disposed inward of the inner circumferential surface (shroud surface 321) of the sliding member 32 of the shroud 30. The impeller 10 is so disposed as to be rotatable around the rotational shaft 13. The impeller 10 has plural circumferentially-arranged blades 15 projecting from an outer circumferential surface of a hub 14. The plural blades 15 are arranged in a manner as to face the shroud surface 321 of the sliding member 32.

As shown in FIG. 1, a compressor equipped with the compressor housing 1 for a supercharger of the present embodiment takes in supplied air from the intake port 11 through the intake passage 314 by rotation of the impeller 10. This intake air is accelerated by the blades 15 of the impeller 10, and is sent into the diffuser 33. The pressure of the supplied air is increased at the diffuser 33, and is then sent into the scroll chamber 12.

Figure 5:
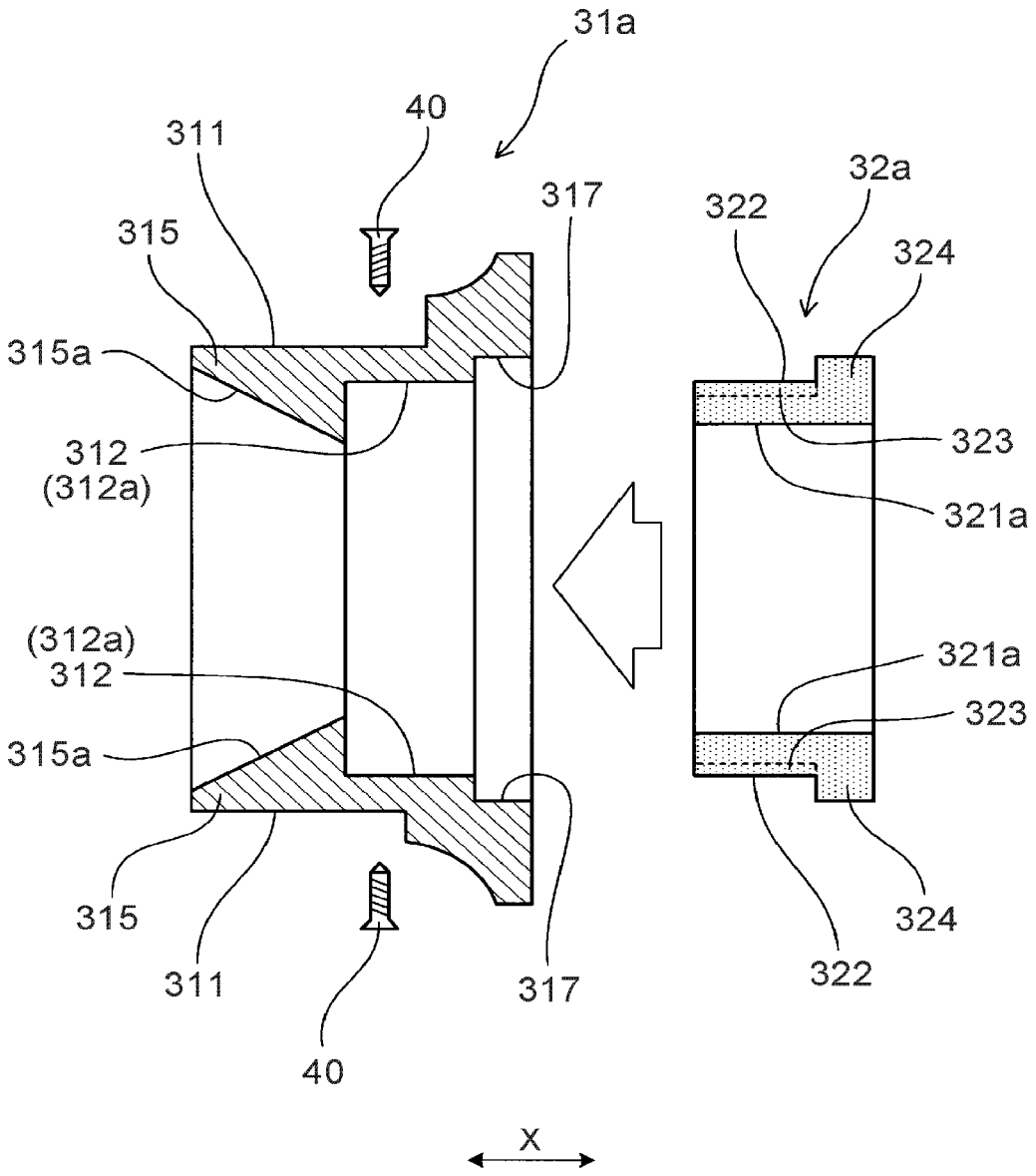
FIG. 5 is a sectional view for explaining an assembly method of the shroud in the first embodiment.

An assembly method of the compressor housing 1 of the present embodiment will be described hereinafter. Prior to assembly of the compressor housing 1 of the present embodiment, a pre-formed sliding member 32*a* and a pre-formed sliding-member fixing portion 31*a* are prepared, as shown in FIG. 5. The pre-formed sliding member 32*a* is in a state before the shroud surface 321 is formed in the inner circumferential surface of the sliding member 32. The pre-formed sliding-member fixing portion 31*a* is in a state before an inner circumferential surface 315*a* of the cylindrical press-fitted portion 315 in the sliding-member fixing portion 31 is formed. An outer diameter of the enlarged-diameter portion 324 of the pre-formed sliding member 32*a* is slightly greater than an inner diameter of the press-fitting recess portion 317 of the pre-formed sliding-member fixing portion 31*a*.

The pre-formed sliding member 32*a* as shown in FIG. 5 is then inserted in the inner circumferential surface 312 of the pre-formed sliding-member fixing portion 31*a*. Each linear projection 323 is brought into contact with each corresponding contact portion 312*a*. The enlarged-diameter portion 324 is press-fitted into the press-fitting recess portion 317 so as to dispose the pre-formed sliding member 32*a* into the sliding-member disposing portion 316. At this time, each linear projection 323 is formed on the outer circumferential surface 322 of the pre-formed sliding member 32*a*. The contact portions 312*a* are part of the inner circumferential surface 312 of the pre-formed sliding-member fixing portion 31*a*.

Figure 6:
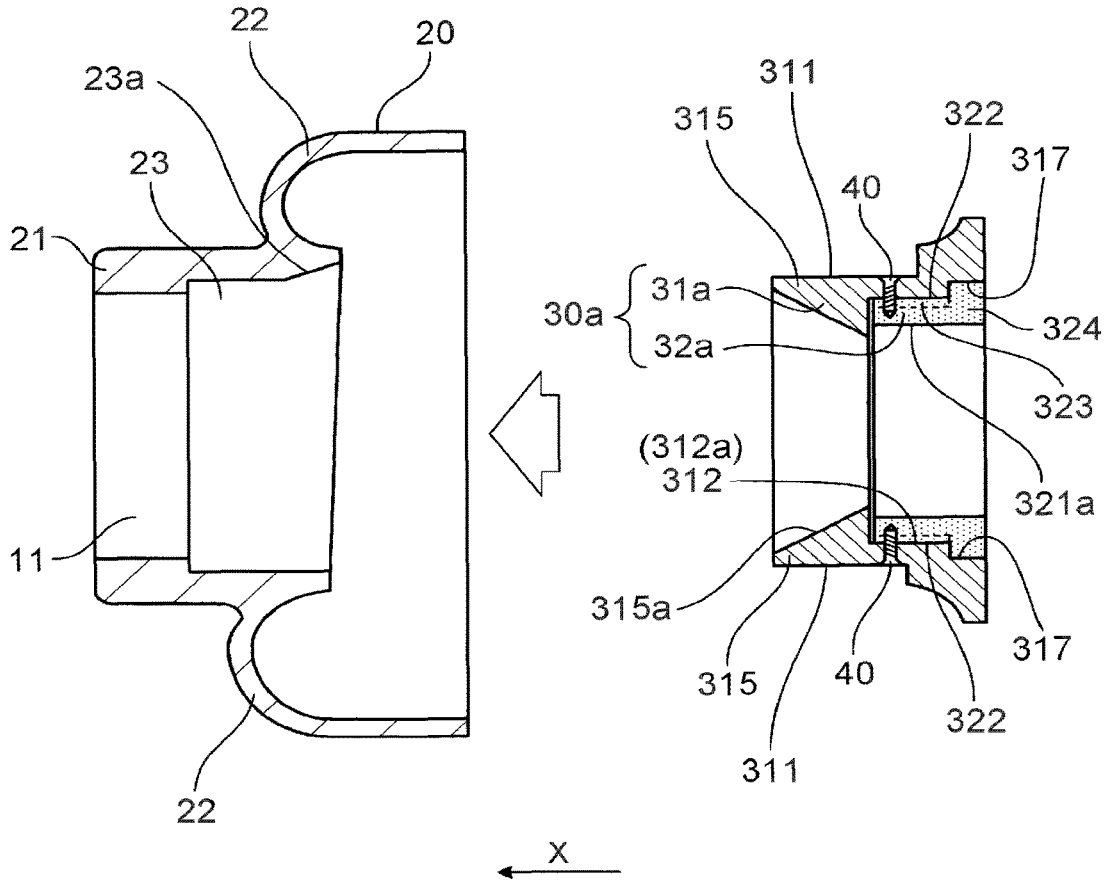
FIG. 6 is a sectional view for explaining the assembly method of the shroud in the first embodiment.

Subsequently, at each contact portion 312*a*, each screw hole 318 is formed in the pre-formed sliding-member fixing portion 31*a* by simultaneous machining from the outer circumferential surface 311 of the cylindrical press-fitted portion 315 to each corresponding linear projection 323 of the pre-formed sliding member 32*a*. Each screw hole 325 is also formed in the pre-formed sliding member 32*a* (see FIG. 3). Each fastening member 40 is screwed through each corresponding screw hole 318 and each corresponding screw hole 325. The pre-formed sliding member 32*a* is fastened to the pre-formed sliding-member fixing portion 31*a*. In this manner, as shown in FIG. 6, there is formed a pre-formed shroud 30*a* in which the pre-formed sliding-member fixing portion 31*a* is integrated with the pre-formed sliding member 32*a*. Before the pre-formed sliding member 32*a* is press-fitted into the pre-formed sliding-member fixing portion 31*a*, prepared holes may be previously formed in the pre-formed sliding member 32*a* and the pre-formed sliding-member fixing portion 31*a*. The prepared holes are holes for screwing the respective fastening members 40 into positions corresponding to the respective screw holes 318 and 325. The fastening members 40 may be screwed into the prepared holes after the pre-formed sliding member 32*a* is press-fitted into the pre-formed sliding-member fixing portion 31*a*. After the pre-formed sliding member 32*a* is press-fitted into the pre-formed sliding-member fixing portion 31*a*, the pre-formed sliding member 32*a* and the pre-formed sliding-member fixing portion 31*a* are fastened to form the pre-formed shroud 30*a*.

Subsequently, the pre-formed shroud 30*a* is press-fitted into the shroud press-fitting portion 23 of the scroll 20 from the opposite side to the intake port 11 of the scroll 20. A cut-out portion 23*a* is formed in part of the shroud press-fitting portion 23 on the opposite side to the intake port 11. In the present embodiment, as shown in FIG. 1, one of the fastening members 40 has a head 40*a* facing the cut-out portion 23*a*. The head 40*a* of the fastening member 40 is exposed to a space 25 surrounded by the cut-out portion 23*a* and the outer circumferential surface 311 of the sliding-member fixing portion 31.

An inner circumferential surface 315*a* of the pre-formed sliding-member fixing portion 31*a* and an inner circumferential surface 321*a* of the pre-formed sliding member 32*a* are formed through continuous cutting. Accordingly, as shown in FIG. 2, the inner circumferential surface 315*b* of the cylindrical press-fitted portion 315 in the sliding-member fixing portion 31, and the shroud surface 321 in the pre-formed sliding member 32*a* are continuously formed without providing any step or gap therebetween. In this manner, the shroud 30 is completed with the scroll 20 press-fitted therein.

The scroll chamber 12 is formed by the scroll-chamber defining portion 22 of the scroll 20 and the scroll-chamber defining portion 313 of the sliding-member fixing portion 31. In this manner, the compressor housing 1 is completed.

Operation and effect of the compressor housing 1 for a supercharger of the present embodiment will be described in details, hereinafter. In the aforementioned compressor housing 1 for a supercharger, the sliding member 32 is fastened to the sliding-member fixing portion 31 by the fastening members 40. Each fastening member 40 is so fixed as to extend through the sliding-member fixing portion 31 from the outer circumferential surface 311 of the sliding-member fixing portion 31 to each corresponding linear projection 323 of the sliding member 32. This configuration prevents each fastening member 40 from being exposed toward the fluid passage (diffuser 33). Hence, it is unnecessary to prepare any accepting recess portion to prevent part of each fastening member 40 from projecting to the fluid passage (diffuser 33). Accordingly, it is possible to prevent disturbance of the air flow discharged from the impeller 10 at the shroud surface 321 of the sliding member 32 and the diffuser surface 319. Hence, it is also possible to prevent deterioration of compression efficiency.

It is unnecessary to provide any accepting recess portion to the diffuser surface 319. Hence, no water or the like is collected, and thus there is no concern about corrosion. In addition, it is possible to eliminate a process to fill the accepting recess portions with putty or the like, which prevents increase in material cost. It is unnecessary to enlarge the sliding member 32 to the diffuser 33 that is an area not facing the impeller 10 in order to secure an area for fixing the fastening members 40 to the sliding member 32. Accordingly, it is possible to promote reduction in dimension of the sliding member 32, which is advantageous to cost efficiency.

In the present embodiment, the sliding member 32 is inserted in the inner circumferential surface 312 of the sliding-member fixing portion 31 in the axial direction of the impeller 10. Each fastening member 40 extends through the sliding-member fixing portion 31 in the direction orthogonal to the axial direction X of the impeller 10. Accordingly, it is possible to securely fix the sliding member 32 to the inner circumferential surface 312 of the sliding-member fixing portion 31.

In the present embodiment, the linear projections 323 are provided to the outer circumferential surface 322 of the sliding member 32. Each linear projection 323 comes into contact with each corresponding contact portion 312*a*, and extends in the axial direction X of the impeller 10. Accordingly, it is possible to prevent the sliding member 32 from being deformed due to fastening by the fastening members 40.

In the present embodiment, the sliding member 32 has the enlarged-diameter portion 324 at the rear end of the sliding member 32. The sliding member 32 is inserted into the sliding-member disposing portion 316 in the axial direction X. The rear end denotes an end of the sliding member 32 opposite to the intake port 11 relative to the fastening members 40 in the direction X. The sliding-member fixing portion 31 includes the press-fitting recess portion 317 into which the enlarged-diameter portion 324 is press-fitted at a position facing the outer circumferential surface of the enlarged-diameter portion 324 after being press-fitted. Accordingly, in a state before the fastening members 40 are fixed, the sliding member 32 (pre-formed sliding member 32*a*) can be fixed to the sliding-member fixing portion 31 (pre-formed sliding-member fixing portion 31*a*). Hence, it is possible to facilitate the fastening operation using the fastening members 40. Compared with the case of increasing the diameter of the entire outer circumferential surface 322 of the sliding member 32 for the press-fitting, it is possible to reduce material of forming the sliding member 32, which is advantageous to cost efficiency.

In the present embodiment, screw members are used as the fastening members 40, but the present invention is not limited to this. For example, fastening members unnecessary to be screwed, such as rivets, may be used as the fastening members 40. In addition, as the fastening members 40, an adhesive agent having a predetermined viscosity may be used in such a manner that the screw holes 318 of the sliding-member fixing portion 31 together with the screw holes 325 of the sliding member 32 are filled with the adhesive agent at a time so as to bond the sliding-member fixing portion 31 and the sliding member 32.

In the present embodiment, the compressor housing 1 is configured to be divided into two: the scroll 20 and the shroud 30, but the present invention is not limited to this, and the compressor housing 1 may be divided into three.

In the present embodiment, in the sliding member 32, the linear projection 323 is disposed at two positions in the diameter direction on the outer circumferential surface 322 of the sliding member 32 so as to fasten the sliding member 32 with the two fastening members 40 at two fastening positions. However, the fastening position may be one or more.

As aforementioned, according to the present embodiment, it is possible to provide the compressor housing 1 for a supercharger capable of preventing deterioration of compression efficiency, and advantageous to cost efficiency.

Figure 7:
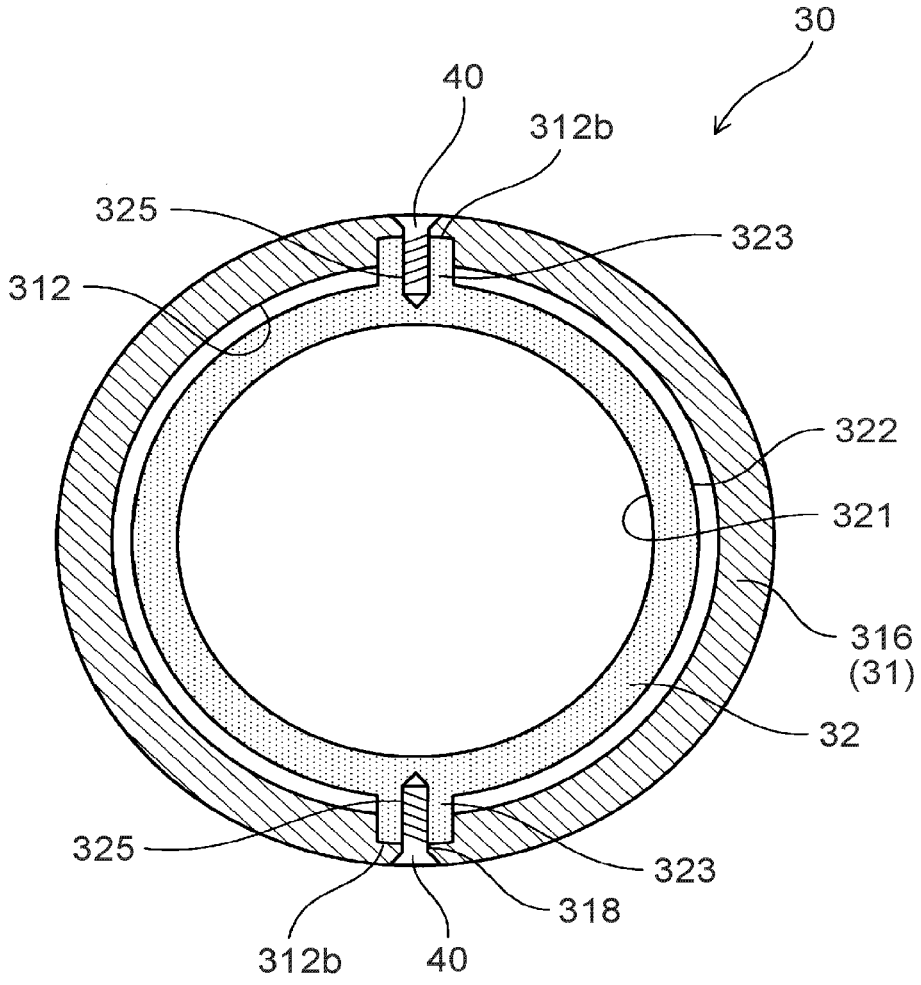
FIG. 7 is a sectional view corresponding to the sectional view taken along line II-II of FIG. 2 in a second embodiment.

In the compressor housing 1 for a supercharger of the second embodiment, as shown in FIG. 7, linear recess portions 312*b* into which the corresponding linear projections 323 of the sliding member 32 are to be fitted, are provided to the inner circumferential surface 312 of the sliding-member fixing portion 31 at positions facing the corresponding linear projections 323 of the sliding member 32. The sliding member 32 is fastened to the sliding-member fixing portion 31 while the linear projections 323 are fitted in the corresponding linear recess portions 312*b*. The same reference numerals are used for components that are common to the first embodiment, and description thereof will be omitted.

According to the present embodiment, at the time of fixing the sliding member 32 (pre-formed sliding member 32*a*) into the sliding-member fixing portion 31 (pre-formed sliding-member fixing portion 31*a*), the linear projections 323 of the sliding member 32 are simply fitted into the corresponding linear recess portions 312*b* of the sliding-member fixing portion 31. Accordingly, it becomes easier to position the sliding member 32. The linear projections 323 of the sliding member 32 are held by the linear recess portions 312*b* of the sliding-member fixing portion 31. Accordingly, it is possible to prevent deformation of the sliding member 32 due to fastening by the fastening members 40. In the present embodiment, it is possible to promote advantageous effect equal to that of the compressor housing 1 of the first embodiment.

The invention claimed is:

1. A compressor housing for a supercharger comprising:
an intake port housing an impeller, the intake port being configured to take in air toward the impeller;

a scroll having a scroll chamber, the scroll chamber being configured to introduce the air discharged from the impeller;

a shroud including a shroud surface, the shroud surface facing the impeller, the shroud including a sliding member in an annular shape and a sliding-member fixing portion in an annular shape; and an inner circumferential surface of the sliding member being the shroud surface, the sliding-member fixing portion including contact portions, the contact portions being located on an inner circumferential surface of the sliding- member fixing portion, the contact portions being configured to contact with at least part of an outer circumferential surface of the sliding member, the sliding member being fastened to the sliding-member fixing portion at the contact portions by fastening members, the fastening members extending through the sliding-member fixing portion, and the fastening members being fastened from an outer circumferential surface of the sliding-member fixing portion to the sliding member, and wherein linear projections are disposed to the outer circumferential surface of the sliding member, and the linear projections are configured to contact with the contact portions, and the linear projections extend in an axial direction of the impeller.

2. The compressor housing according to claim 1, wherein the sliding member is inserted in the inner circumferential surface of the sliding-member fixing portion in the axial direction of the impeller, and the fastening members extend through the sliding-member fixing portion in a direction orthogonal to the axial direction of the impeller.

3. The compressor housing according to claim 1, wherein linear recess portions are fitted to the linear projections, and the linear recess portions are provided on the inner circumferential surface of the sliding-member fixing portion.

4. The compressor housing according to claim 2, wherein linear recess portions are fitted to the linear projections, and the linear recess portions are provided on the inner circumferential surface of the sliding-member fixing portion.

5. The compressor housing according to claim 2, wherein the sliding member includes an enlarged-diameter portion located on an opposite side to the intake port relative to the fastening members in a direction in which the sliding member is inserted, the enlarged-diameter portion has a diameter increased in a direction away from the intake port side toward the opposite side, and the sliding-member fixing portion includes a press-fitting recess portion into which the enlarged-diameter portion is press-fitted, and the press-fitting recess portion is disposed at a position facing an outer circumferential surface of the enlarged-diameter portion.

6. The compressor housing according to claim 1, wherein the sliding member includes an enlarged-diameter portion located on an opposite side to the intake port relative to the fastening members in a direction in which the sliding member is inserted, the enlarged-diameter portion has a diameter increased in a direction away from the intake port side toward the opposite side, and the sliding-member fixing portion includes a press-fitting recess portion into which the enlarged-diameter portion is press-fitted, and the press-fitting recess portion is disposed at a position facing an outer circumferential surface of the enlarged-diameter portion.

7. The compressor housing according to claim 3, wherein the sliding member includes an enlarged-diameter portion located on an opposite side to the intake port relative to the fastening members in a direction in which the sliding member is inserted, the enlarged-diameter portion has a diameter increased in a direction away from the intake port side toward the opposite side, and the sliding-member fixing portion includes a press-fitting recess portion into which the enlarged-diameter portion is press-fitted, and the press-fitting recess portion is disposed at a position facing an outer circumferential surface of the enlarged-diameter portion.

8. The compressor housing according to claim 4, wherein the sliding member includes an enlarged-diameter portion located on an opposite side to the intake port relative to the fastening members in a direction in which the sliding member is inserted, the enlarged-diameter portion has a diameter increased in a direction away from the intake port side toward the opposite side, and the sliding-member fixing portion includes a press-fitting recess portion into which the enlarged-diameter portion is press-fitted, and the press-fitting recess portion is disposed at a position facing an outer circumferential surface of the enlarged-diameter portion.

* * * * *